US010435962B2

(12) United States Patent
Nunes et al.

(10) Patent No.: US 10,435,962 B2
(45) Date of Patent: Oct. 8, 2019

(54) TOP-MOUNTED COMPENSATOR FOR USE IN A MOTION COMPENSATION SYSTEM

(71) Applicant: Cameron International Corporation, Houston, TX (US)

(72) Inventors: Tiago Manuel Fernandes Nunes, Kristiansand S. (NO); Nils Christian Hagen, Kristiansand S. (NO); Hakon Frank Bergan, Kristiansand S. (NO)

(73) Assignee: Cameron International Corporation, Houston, TX (US)

( * ) Notice: Subject to any disclaimer, the term of this patent is extended or adjusted under 35 U.S.C. 154(b) by 275 days.

(21) Appl. No.: 15/227,472

(22) Filed: Aug. 3, 2016

(65) Prior Publication Data

US 2018/0038173 A1 Feb. 8, 2018

(51) Int. Cl.

| | |
|---|---|
| ***E21B 19/00*** | (2006.01) |
| ***E21B 19/09*** | (2006.01) |
| ***B66D 1/36*** | (2006.01) |
| ***B66C 13/10*** | (2006.01) |
| ***B66D 1/50*** | (2006.01) |
| ***B66D 3/08*** | (2006.01) |

(52) U.S. Cl.

CPC ..... *E21B 19/006* (2013.01); *B66C 13/10* (2013.01); *B66D 1/365* (2013.01); *B66D 1/50* (2013.01); *B66D 3/08* (2013.01); *E21B 19/09* (2013.01)

(58) Field of Classification Search

CPC ..... E21B 19/006; E21B 19/09; B66C 13/02; B66C 13/10; B66D 1/50; B66D 1/365; Y10S 254/90

See application file for complete search history.

(56) References Cited

U.S. PATENT DOCUMENTS 3,469,820 A * 9/1969 Horton ..... E21B 15/02 175/5
3,549,129 A * 12/1970 Graham ..... B63B 21/56 114/245
3,791,628 A * 2/1974 Burns ..... B66D 1/48 254/277
3,804,183 A * 4/1974 Duncan ..... B63B 35/4413 173/4

(Continued)

FOREIGN PATENT DOCUMENTS

| | | |
|---|---|---|
| CN | 204283252 U | 4/2015 |
| WO | 2016066776 A1 | 5/2016 |
| WO | WO2016066776 A1 | 5/2016 |

OTHER PUBLICATIONS

International Search Report and Written Opinion for corresponding PCT Application Serial No. PCT/US2017/045213 dated Nov. 9, 2017, 15 pages.

*Primary Examiner* — Michael E Gallion
(74) *Attorney, Agent, or Firm* — Helene Raybaud

(57) ABSTRACT

A bell design crown block for a top mounted compensator includes a removable, tilting sheave block mounted within the outside perimeter of a crown block yoke. An actuator installed in the crown block actuates the tilt function. No hinge adaptor is required and the sheave block does not hang past or below the crown block yoke. When used in a floating platform application, idler sheaves are mounted on the crown block yoke and an optional interface beam may be provided for the active heave cylinder head.

18 Claims, 4 Drawing Sheets

(56) References Cited

U.S. PATENT DOCUMENTS 3,940,112 A * 2/1976 Lea ..... B66D 3/08 254/399
4,002,321 A * 1/1977 Shaw ..... B66D 1/365 212/97
4,492,363 A * 1/1985 Niskin ..... B66D 3/06 254/275
4,576,517 A * 3/1986 McCann ..... E21B 19/09 114/264
4,688,764 A * 8/1987 Nayler ..... B66C 13/02 254/277
5,520,369 A * 5/1996 Chatard ..... B66C 13/02 254/277
6,926,103 B1 * 8/2005 Roodenburg ..... B66D 3/043 175/171
7,461,831 B2 * 12/2008 Mosley ..... E21B 7/023 254/277
7,828,086 B2 * 11/2010 Lesko ..... E21B 7/023 166/77.1
8,256,520 B2 * 9/2012 Lucas ..... B63B 35/4413 166/352
8,534,387 B2 * 9/2013 Taraldrud ..... E21B 19/02 166/75.14
9,784,051 B2 * 10/2017 Bergan ..... B63B 39/00
2005/0056819 A1 * 3/2005 Pockl ..... B66D 1/365 254/277
2008/0099208 A1 5/2008 Moncus et al.
2009/0134373 A1 * 5/2009 Arzberger ..... B66D 1/365 254/361
2010/0176079 A1 * 7/2010 Lucas ..... B63B 35/4413 212/307
2014/0246203 A1 * 9/2014 Pohner ..... E21B 19/09 166/355
2015/0008381 A1 * 1/2015 Hausladen ..... B66D 1/30 254/288
2015/0008382 A1 1/2015 Bergan

* cited by examiner

TOP-MOUNTED COMPENSATOR FOR USE IN A MOTION COMPENSATION SYSTEM

BACKGROUND

The invention relates to a top-mounted compensator for use in a motion compensation system like those used in connection with an oil and gas vessel.

The operations of many floating vessels, such as semi-submersible drilling rigs, drill ships, and pipe-laying ships, are impeded by sea swell or waves. Sea waves impart an up-and-down motion to the vessel, commonly referred to as "heave." The waves can last anywhere from a few seconds up to about 30 seconds or so, and their height can range from a few centimeters or inches up to about 15 meters (about 50 feet) or more.

This up-and-down heave motion is correspondingly imparted to any loads or structures attached to the vessel. Heave motion of the loads or structures is often highly undesirable, and even dangerous, to equipment and personnel. For example, when attempting to drill a wellbore in the sea bed, the heave motion can cause a corresponding motion of the drill string and the drill bit attached to the end of the drill string, severely restricting the operating window of the rig. As much as 20% of rig operating time in the North Sea can be lost "waiting on weather" or calmer seas.

Heave compensation is directed to reducing the effect of this up-and-down heave motion on the load or structure attached to the vessel. "Passive" heave compensation systems fix the load to a point, such as the sea bed. When sea swell causes the vessel to move relative to the load, the passive compensator uses compressed air to provide a low frequency dampening effect between the load and the vessel.

"Active" heave compensation systems measure the movement of the floating vessel using a measuring device such as a motion reference unit and use the measured movement to control a drive that moves a connection device, such as a traveling block or a crane hook, relative to the vessel. The drive that moves the connection device is typically a drawworks (winch) in block and tackle arrangement to the connection device. The drawworks can reel its cable in-and-out to cause the connection device to be raised and lowered relative to the vessel. The block used in the block and tackle arrangement is a crown block.

Prior art crown blocks do not provide for sheave tilt actuation or idler sheave location, make use of a hinge adaptor, and mount the sheave block so that it hangs past or below the crown block yoke, thereby requiring a lot of height, weight and space (see e.g. U.S. Pat. No. 8,534,387 B2 to Taraldrud). As the weight of the crown block increases, so does the weight of the crown beam that supports the block.

Despite the advance in both passive and active heave compensation systems, heave compensation remains a priority to increase the safety and efficiency of floating vessels.

SUMMARY

A bell design crown block for a top mounted compensator includes a removable, tilting sheave block mounted within the outside perimeter of a crown block yoke. An actuator installed in the crown block actuates the tilt function. No hinge adaptor is required and the sheave block does not hang past or below the crown block yoke. When used in a floating platform application, idler sheaves are mounted on the crown block yoke and an optional interface beam may be provided for the active heave cylinder head. (The idler sheaves are typically mounted to the derrick in fixed platform applications.)

The crown block allows incorporation of a removable and tilting sheave block in a small amount of space. The sheave block can safely be dismounted, and the height and weight of the assembly is much smaller compared to existing solutions.

Objectives of the preferred embodiments include providing a crown block that (1) is lower in weight and overall height than prior art crown blocks; (2) includes a removable and titling sheave block with actuated tilt function; (3) can include idler sheaves at the same level as the sheave block to prevent collision between the drill wire and the sheave block when the sheave block is titled; (4) makes use of an interface beam where active heave compensation is used; (5) reduces the fleet angle between the sheaves located on the crown block and the drill wire to extend the wire's operation life; and (6) reduces the height, weight and cost of the derrick.

ELEMENTS AND NUMBERING USED IN THE DRAWINGS AND DETAILED DESCRIPTION

Figure 1:
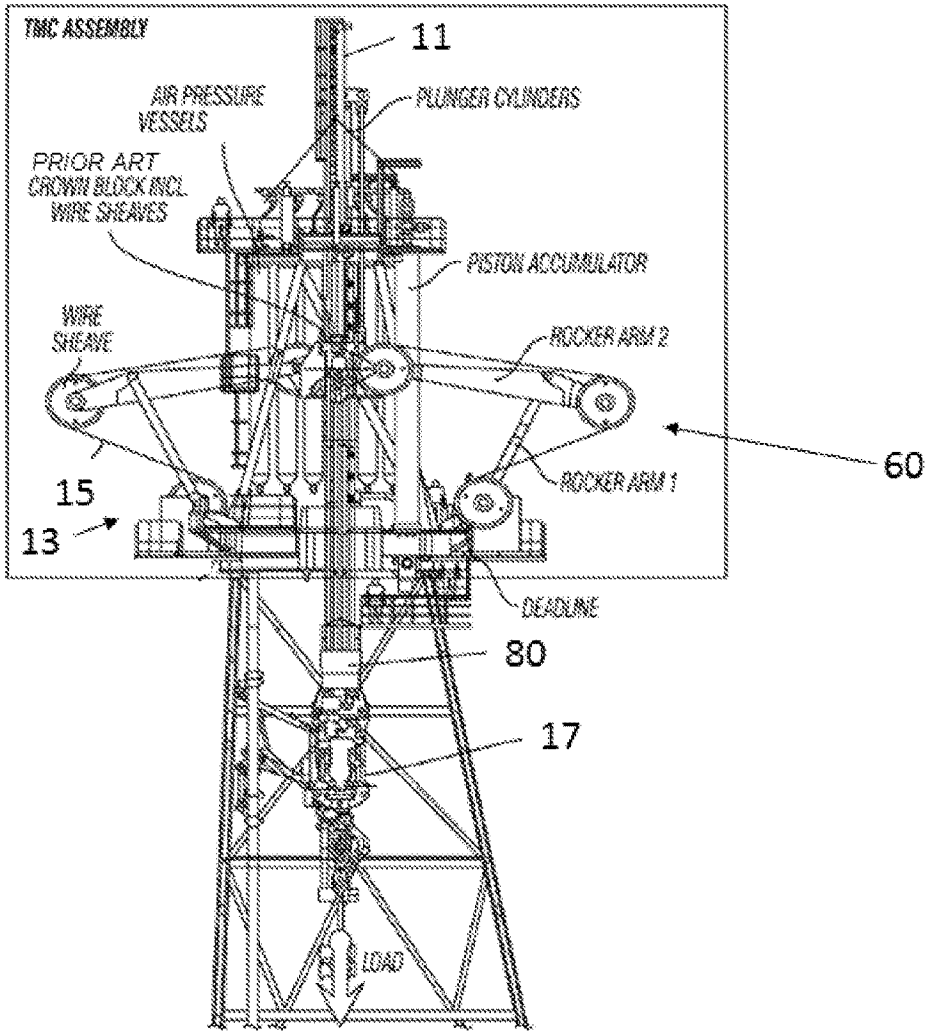
FIG. 1 shows an example of a top mounted compensator assembly in which preferred embodiments of the crown block may be a part. The crown block shown here is a prior art crown block.
Figure 3:
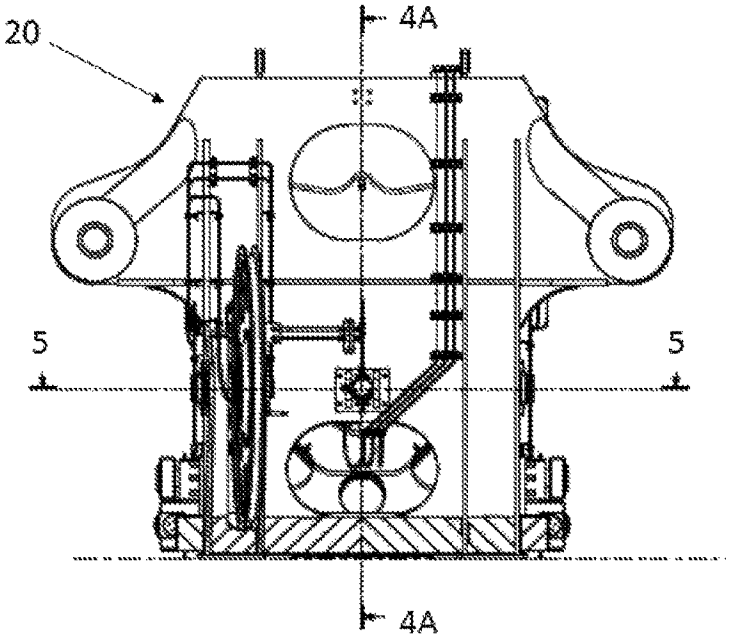
FIG. 3 is a side elevation view of a preferred embodiment of the crown block.
Figure 2:
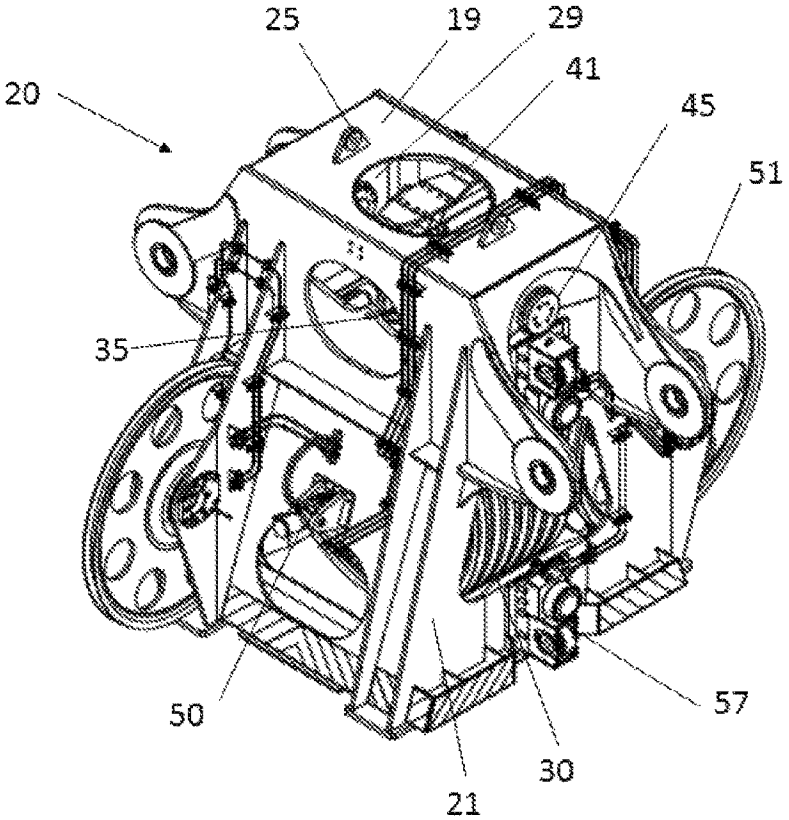
FIG. 2 is an isometric view of a preferred embodiment of the crown block. The crown block includes a removable, tilting sheave block located within the crown block yoke.
Figure 4B:
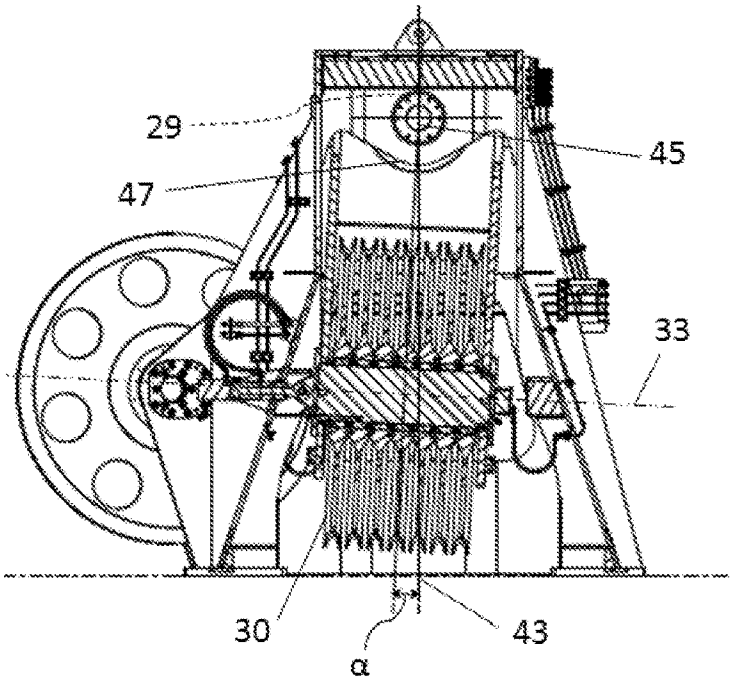
FIG. 4B is section view of with the sheave block tilted at an angle "a" by an actuator.
Figure 4A:
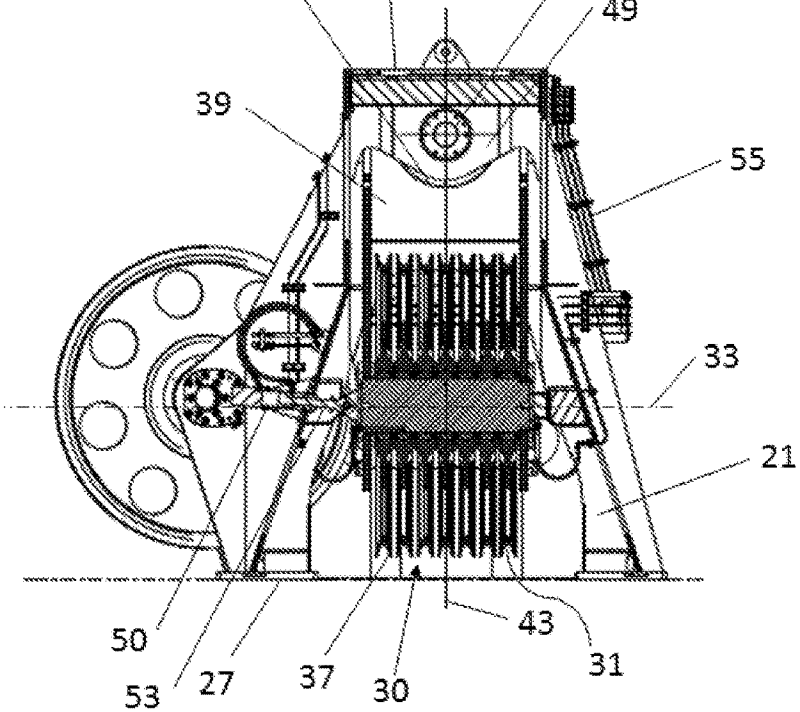
FIG. 4A is a section view of the crown block taken along section line 4A-4A of FIG. 3 showing the sheave block in an inline position.
Figure 6:
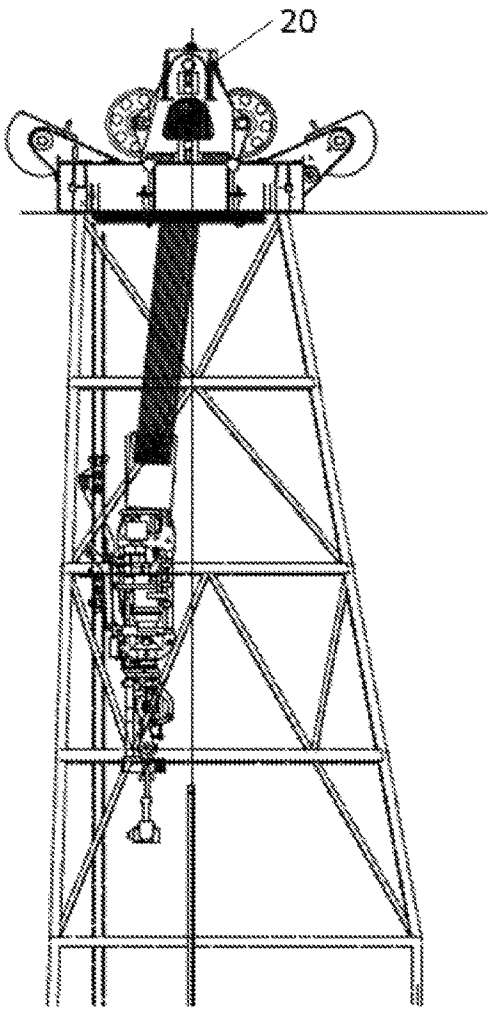
FIG. 6 shows an example of the crown block when landed on the water table with the sheave block tilted. Other portions of the top mounted compensator assembly shown in FIG. 1, as well as the lower end of the derrick and the drill floor, are not shown in this view.
Figure 5:
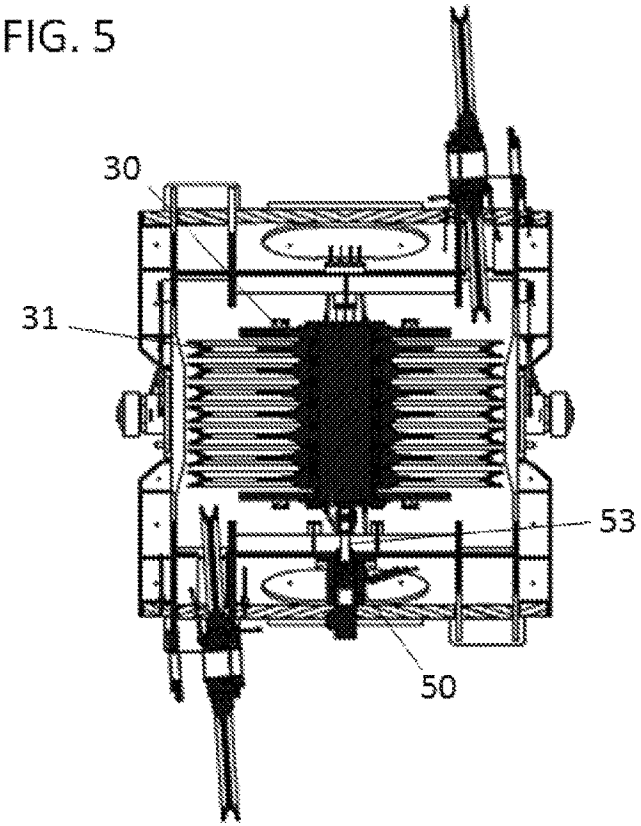
FIG. 5 is a section view taken along section line 5-5 of FIG. 3.

10 Motion compensation system
11 Active heave compensator
13 Drawworks (usually located at drillfloor)
15 Cable
17 Top drive
19 Top end or plane of 20
20 Crown block (with bell design)
21 Crown block yoke
25 Pad eyes
27 Bottom end or plane of 21
29 Top end or plane of 21
30 Sheave block
31 Sheaves
33 Central (rotational) axis of 30
35 Pad eyes
37 Bottom end
39 Top end
41 Interface beam

43 Centerline (running perpendicular to the central rotational axis of the sheave block)
45 Interface axle
47 Hinge or hinge joint
49 Axle mount
50 Actuator (arranged at or about the central rotational axis of the sheave block)
51 Idler sheaves
53 Actuator rod
55 Lubrication manifold
57 Guide rail rollers
60 Stabilizing (rocker arms and sheaves) assembly
80 Traveling block
α Tilt angle

DETAILED DESCRIPTION OF THE PREFERRED EMBODIMENTS

Referring now to FIG. 1, a motion compensation system 10 is shown in which preferred embodiments of a crown block 20 may be a part (see FIGS. 2-6). In one embodiment, the motion compensation system 10 includes a top-mounted crown block 20 that has a bell design, a traveling block 80, and an optional stabilizing assembly 60 made of rocker arms and wire sheaves located between the two blocks 20, 80. A cable 15—with one end connected to the drawworks 13 and the other end connected to the floating vessel as a deadline—passes through the crown block 20 and the optional stabilizing assembly 60

The cable 15, along with the stabilizing assembly 60, is used to control the movement of the crown block 20 relative to the traveling block 80. When used in fixed platform applications, stabilizing assembly 60 is not needed. In floating platform applications, stabilizing assembly 60 helps improve performance.

The traveling block 80 may be connected to a top drive 17 that helps move the traveling block 80 and imparts a load on the drill string. The crown block 20 may be coupled to compensator cylinders in a manner similar to that described in US 2015/0008382 A1 to Bergan (herein incorporated by reference).

Referring now to FIGS. 2-6, a preferred embodiment of the crown block 20 includes pad eyes 25 and a crown block yoke 21 that houses a tilting sheave block 30. Sheave block 30 removably connects to the crown block yoke 21 by two interface axles 45 and includes pad eyes 35. The interface axles 45 are located toward (and under) a top end 29 of the crown block yoke 21.

An actuator 50 is installed in the crown block 20 to actuate the tilt function of the sheave block 30. Actuator 50 includes electromechanical, hydraulic or pneumatic controls and related circuitry of a kind known in the art to create the desired amount of actuation (and resulting tilt angle α). Where active heave compensation is used, crown block 20 may include an interface beam 41 in communication with an active heave compensator 11.

Actuator 50, which includes a rod 53 connected to the sheave block 30, is arranged at or about a central rotational axis 33 of the sheave block 30 to move the sheave block 30 between an inline position and a tilted position relative to a center line 43 of the crown block 20. When actuator 50 is in its neutral position, the sheave block 30 is in the inline position. When actuator 50 is in a retracted (pull) position relative to neutral, sheave block 30 is in the titled position.

The degree of tilt relative to a centerline 43 of the crown block 20 is determined by application requirements. Regardless of the degree of tilt, the tilt is such that it reduces the fleet angle, thereby extending the drill wire's operating life.

The sheave block 30 is housed within—and does not hang past or below—the crown block yoke 21. The bottom end 37 of the sheave block 30 is located just above the bottom end 27 of the crown block yoke 21 and the top end 39 of the sheave block 30 is located under the top end 19 of the crown block 20. The top end 39, which is complementary in shape to the axle mount 49, acts as a hinge or hinge joint 47.

Two idler sheaves 51 are mounted on the crown block yoke 21 at the same level as the sheave block sheaves 31. This prevents collision between the drill wire and the tilting sheave block 30. When used in a fixed platform application, the idler sheaves 51 may be mounted to the crown block yoke 21 or to the platform.

A lubrication manifold 55 is provided for shear block sheaves 31 and idler sheaves 51 bearing lubrication and for guide rail roller 57 bearing lubrication. The manifold 55 can be accessed from a platform (not shown) that is spaced apart from the crown block 20. Where lubrication-free bearings are used, the manifold 55 can be removed.

The preferred embodiments provide examples of the invention. The invention itself is defined by the following claims, including elements equivalent to those recited in the claims.

What is claimed:

1. A crown block arranged for use in a top mounted compensator, the crown block [20] comprising:
- a crown block yoke [21] housing a sheave block [30] having a central rotational axis; and
- an actuator [50] connected to the sheave block at the central rotational axis of the sheave block and arranged to move the sheave block between an inline position and a tilted position relative to a center line [43] of the crown block.

2. A crown block according to claim 1 further comprising an active heave compensator interface beam located toward a top end [19] of the crown block.

3. A crown block according to claim 1 further comprising the crown block yoke sized to house the sheave block entirely between a top end [29] and a bottom end [27] of the crown block yoke.

4. A crown block according to claim 1 further comprising an axle mount [49] located below and toward a top end of the crown block yoke, the axle mount being complementary in shape to the top end of the sheave block.

5. A crown block according to claim 1 further comprising a pair of interface axles [45] located in an axle mount under a top end of the crown block yoke, wherein the sheave block removably connects to the crown block yoke by the pair of interface axles.

6. A crown block according to claim 1 further comprising a pair of idler sheaves [51] mounted to the crown block yoke at a same level as sheaves [31] of the sheave block.

7. A crown block according to claim 1 further comprising the actuator including an actuator rod [53] connected to the sheave block.

8. A crown block according to claim 1 further comprising the actuator being housed in the crown block.

9. A crown block according to claim 1 further comprising a lubrication manifold [55] in communication with at least the sheave block sheaves.

10. A crown block arranged for use in a top mounted compensator, the crown block [20] comprising:
- a sheave block [30] having a central rotational axis, said sheave block connected to a crown block yoke [21];

an actuator [50] connected to the sheave block at the central rotational axis of the sheave block and arranged to move the sheave block between a neutral position and a tilted position relative to a center line [43] of the crown block.

11. A crown block according to claim 10 further comprising the crown block yoke housing the sheave block entirely between a top end [29] and a bottom end [27] of the crown block yoke.

12. A crown block according to claim 10 further comprising an active heave compensator interface beam located toward a top end [19] of the crown block.

13. A crown block according to claim 10 further comprising an axle mount [49] located below and toward a top end of the crown block yoke, the axle mount being complementary in shape to the top end of the sheave block, a hinge [47] being formed between the complementary shapes.

14. A crown block according to claim 10 further comprising a pair of interface axles [45] located in an axle mount under a top end of the crown block yoke, wherein the sheave block removably connects to the crown block yoke by the pair of interface axles.

15. A crown block according to claim 10 further comprising a pair of idler sheaves [51] mounted to the crown block yoke at a same level as sheaves [31] of the sheave block.

16. A crown block according to claim 10 further comprising the actuator including an actuator rod [53] connected to the sheave block.

17. A crown block according to claim 10 further comprising the actuator being housed in the crown block.

18. A crown block according to claim 10 further comprising a lubrication manifold [55] in communication with at least the shear block sheaves.

* * * * *